US007614898B2

(12) United States Patent
Lee et al.

(10) Patent No.: US 7,614,898 B2
(45) Date of Patent: Nov. 10, 2009

(54) ELECTRICAL CONNECTOR FOR CONNECTING BETWEEN AN ELECTRONIC CARD AND A PRINTED CIRCUIT BOARD

(75) Inventors: Kuo-Ching Lee, Hsin-Tien (TW); Ta-Teh Meng, Hsin-Tien (TW); Jian-Li Guan, Hsin-Tien (TW)

(73) Assignee: Advanced Connectek Inc., Hsien-Tien, Taipei Hsien (TW)

( * ) Notice: Subject to any disclaimer, the term of this patent is extended or adjusted under 35 U.S.C. 154(b) by 0 days.

(21) Appl. No.: 12/196,177

(22) Filed: Aug. 21, 2008

(65) Prior Publication Data

US 2009/0061689 A1 Mar. 5, 2009

(30) Foreign Application Priority Data

Aug. 31, 2007 (TW) ..... 96214622 U

(51) Int. Cl.
*H01R 13/62* (2006.01)

(52) U.S. Cl. ..... 439/260

(58) Field of Classification Search ..... 439/260, 439/492, 67, 261, 267, 357, 329
See application file for complete search history.

(56) References Cited

U.S. PATENT DOCUMENTS

| | | | | |
|---|---|---|---|---|
| 5,906,498 | A | 5/1999 | Nagafuji | |
| 6,755,682 | B2 * | 6/2004 | Kunishi et al. | 439/495 |
| 7,137,838 | B2 * | 11/2006 | Koga | 439/260 |
| 7,275,954 | B2 * | 10/2007 | Ikenaga et al. | 439/494 |
| 7,306,478 | B2 * | 12/2007 | Kudo et al. | 439/494 |

* cited by examiner

*Primary Examiner*—Chandrika Prasad
(74) *Attorney, Agent, or Firm*—patenttm.us

(57) ABSTRACT

An electrical connector for engaging with an electronic card has a insulative housing with a plurality of receiving spaces, a plurality of terminals respectively mounted in the receiving spaces of the insulative housing, and an operating member pivotally connected to the insulative housing. The operating member controls the terminals in the insulative housing to be moved for electrically and mechanically engagement with the electronic card. Each of the terminals has a base portion, an upper arm and a lower arm. The upper arm is connected to the base portion at a joint as a first fulcrum. The lower arm is connected to the base portion at another joint as a second fulcrum. As the operating member pivotally moves to a predetermined position, the upper arm and the lower arm respectively rotate about the first fulcrum and the second fulcrum to securely grasp the electronic card.

12 Claims, 5 Drawing Sheets

ELECTRICAL CONNECTOR FOR CONNECTING BETWEEN AN ELECTRONIC CARD AND A PRINTED CIRCUIT BOARD

BACKGROUND OF THE INVENTION

1. Field of the Invention

The present invention relates to an electrical connector for electrically connecting to an electronic card, and more particularly to an electrical connector that electrically engages the electronic card with dual contacts.

2. Description of Related Art

Electronic signal connections between a conventional connector and an electronic card are implemented by T-shaped or H-shaped conductive terminals mounted in the conventional connector. Since each of the T-shaped or H-shaped conductive terminals only touches the electronic card at single point, the conventional connector cannot securely engage the electronic card. When unexpected force suddenly impacts the connector, the electronic card may easily disconnect from the connector to interrupt the electronic signal transmission.

With reference to the U.S. Pat. No. 5,906,498, Nagafuji discloses an electrical connector for an electronic card. The electrical connector comprises an operating means, an insulative housing and a plurality of terminals. The insulative housing has a receiving space defined through two opposite sides of the insulative housing. Each of the terminals may be T-shaped or H-shaped and mounted in the receiving space side by side. The operating means as a lever member is pivotally mounted in the receiving space and rotatably abuts a bottom plate of the insulative housing and the terminals.

When a force is applied to press the operating means, the operating means rotates to a predetermined position to lift the terminals at one side of the insulative housing so that the terminals at the other side of the insulative housing move downward based on the principle of leverage. Therefore, an electronic card inserted into and hold in the receiving space can be clamped between the insulative housing and the terminals of the other side, thus accomplishing an electrical connection between the connector and the electronic card in the form of a single point.

However, each terminal touches the electronic card merely at one single point. Therefore, the connector would be engaged loosely with and easily disengage inadvertently from the electronic card, accordingly reducing the reliability of the connector.

To overcome the shortcomings, the present invention provides an electrical connector to mitigate or obviate the aforementioned problems.

SUMMARY OF THE INVENTION

The main objective of the invention is to provide an electrical connector that provides an enhanced electrical and mechanical engagement by forming dual contacts between the electrical connector and an electronic card.

An electrical connector in accordance with the present invention has an insulative housing with a plurality of receiving spaces, a plurality of terminals respectively mounted in the receiving spaces of the insulative housing, and an operating member pivotally connected to the insulative housing. The operating member controls the terminals in the insulative housing to be moved for electrically and mechanically engagement with the electronic card. Each of the terminals has a base portion, an upper arm and a lower arm. The upper arm is connected to the base portion at a joint as a first fulcrum. The lower arm is connected to the base portion at another joint as a second fulcrum. As the operating member pivotally moves to a predetermined position, the upper arm and the lower arm respectively rotate about the first fulcrum and the second fulcrum to securely grasp the electronic card.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
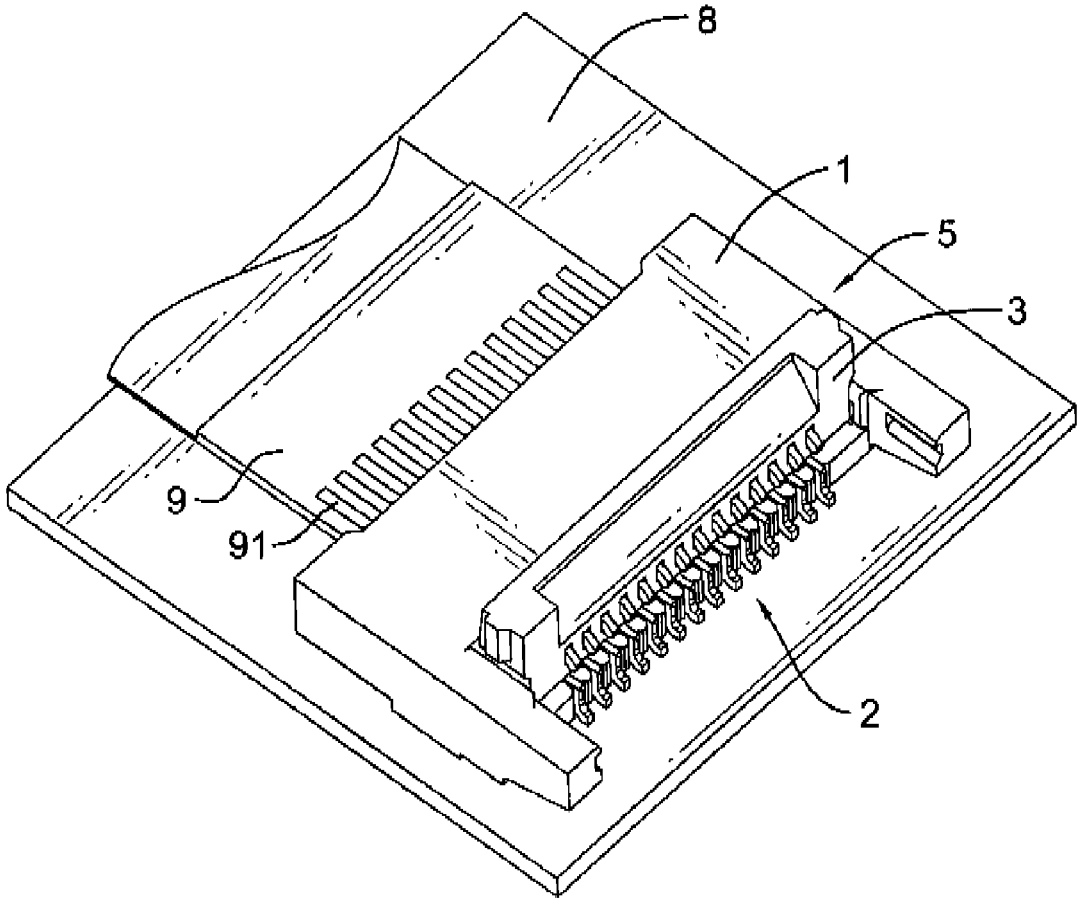
FIG. 1 is a perspective view of a first embodiment of an electrical connector in accordance with the present invention coupled to an electronic card.
Figure 2:
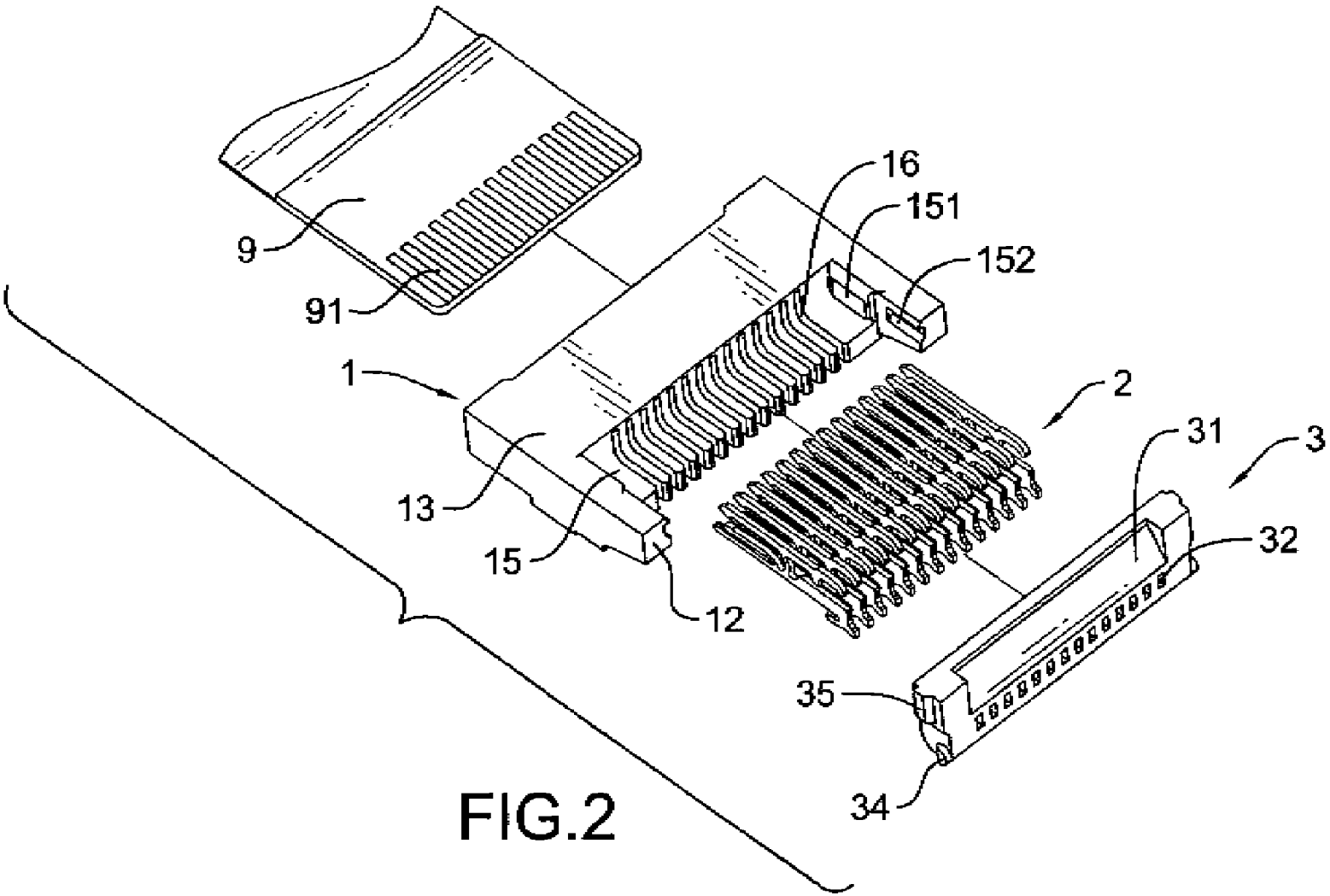
FIG. 2 is an exploded perspective view of the electrical connector shown FIG. 2.
Figure 7:
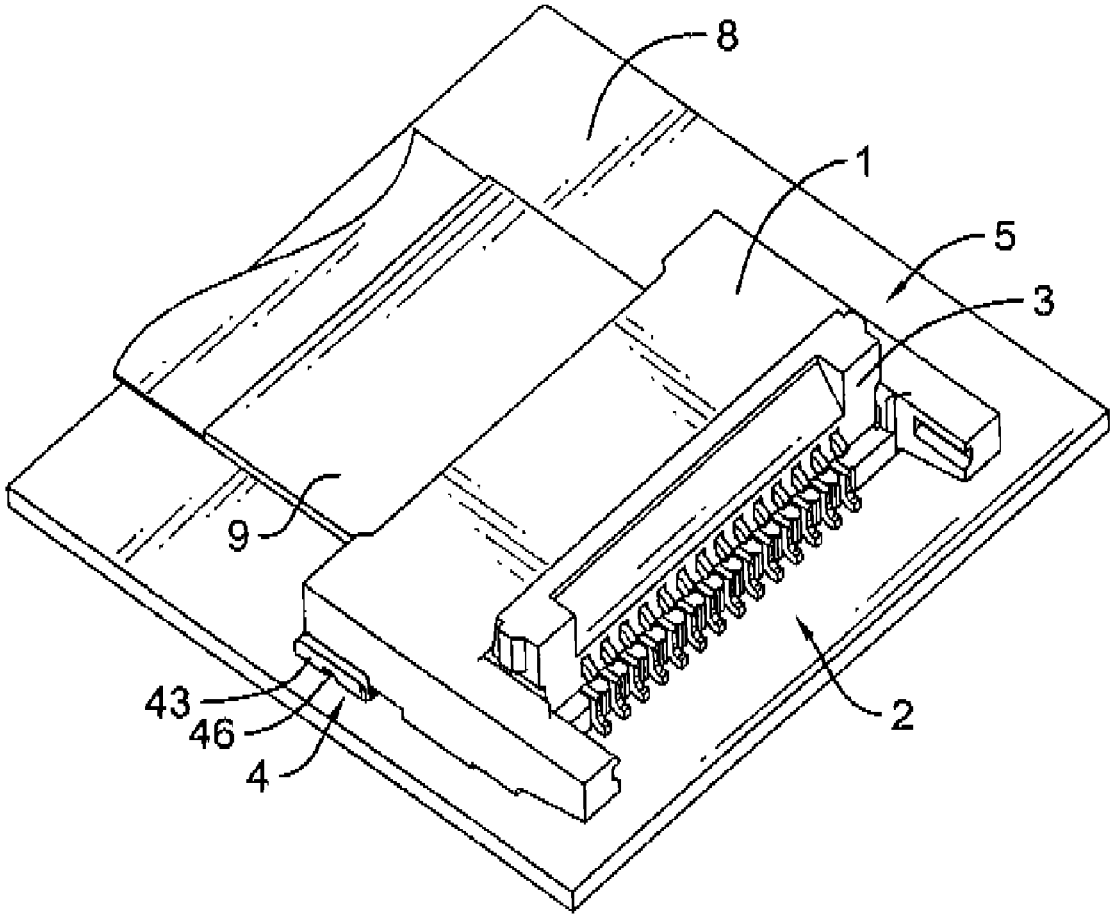
FIG. 7 is a perspective view of a second embodiment of an electrical connector in accordance with the present invention being coupled to an electronic card.

With reference to FIGS. 1, 2 and 7, an electrical connector 5 in accordance with the present invention is electrically mounted on a printed circuit board 8 and comprises an insulative housing 1, a plurality of conductive terminals 2, an operating member 3 and an optional mounting plate 4. The electrical connector 5 can electrically engage an electronic card 9 such as a flexible flat cable (FFC), a flexible printed circuits (FPC) or the like. The electronic card 9 has a plurality of conductive portions 91 formed on either a top surface or bottom surface of the electronic card 9 for signal transmission.

Figure 3:
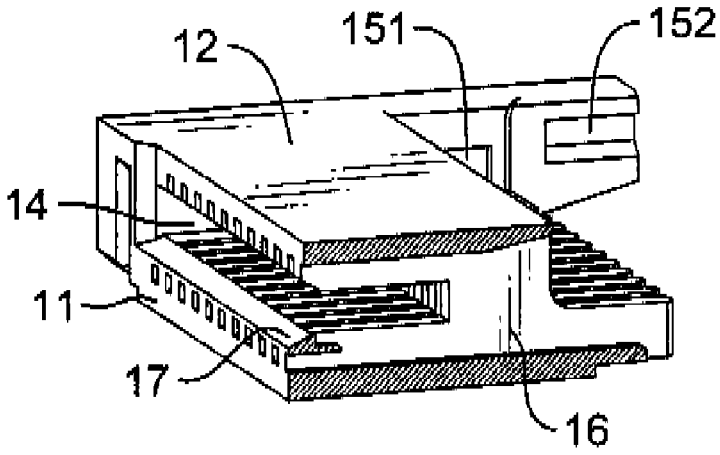
FIG. 3 is a perspective cross sectional view of an insulative housing of the electrical connector in FIG. 1 in accordance with the present invention.

With further reference to FIG. 3, the insulative housing 1 has a front surface 11, a rear surface 12, a top surface 13, a slot 14, a cavity 15, a plurality of receiving spaces 16 and a blocking rib 17. The slot 14 is substantially rectangular, defined in the front surface 11 and has an inner bottom surface. The cavity 15 is defined on the top surface 13, adjacent to the rear surface 12 and has two opposite inner surfaces defined with holes 151 and grooves 152. Each of the receiving spaces 16 is defined in the insulative housing 10 and communicates with the slot 14 and the cavity. The blocking rib 17 is formed on the inner bottom surface of the slot 14 adjacent to the front surface 11.

Figure 4:
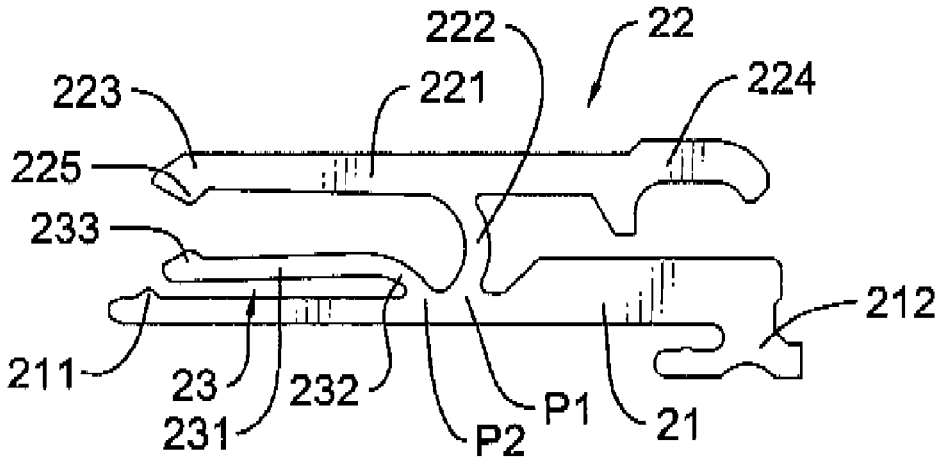
FIG. 4 is a side view of a terminal of the electrical connector in FIG. 1 in accordance with the present invention.

With reference to FIGS. 2 and 4, the terminals 2 are respectively mounted in the receiving spaces 16 of the insulative housing 1. Each terminal 2 comprises a base portion 21 being connected to a substantially J-shaped upper arm 22 and a lower arm 23.

The base portion 21 comprises a locking projection 211 and a terminal portion 212. The locking projection 211 protrudes from one end of the base portion 21 and is placed under the blocking rib 17, against the blocking rib 17 when the terminals 2 are held in the receiving spaces 16. The terminal portion 212 extends from the other end of the base portion 21 for signal transmission between two different electronic devices, such as between the electronic card 9 and the printed circuit board 8.

The upper arm 22 comprises a first beam 221 parallel to the base portion and a support post 222. The support post 222 is arc-shaped and projects in a direction toward the rear surface 12 of the insulative housing 1. The support post 222 has a first end jointed to a center of the first beam 221 and has a second end jointed to a center of the base portion 21 as a first fulcrum P1.

The first beam 221 comprises a contact portion 223, a meshing portion 224 and an optional upper boss 225. The contact portion is parallel to the base portion 21 and extends toward the front surface 11 of the insulative housing 1. The meshing portion 224 is parallel to the base portion 21 and extends toward the rear surface 12 opposite to the contact portion 223. The upper boss 225 with a substantial triangular shape protrudes from a tip of the contact portion 223.

The lower arm 23 is located between the contact portion 223 and the base portion 21 and comprises a resilient contact portion 231, an arc-shaped joining portion 232 and an optional lower boss 233. The resilient contact portion 231 is parallel to the base potion 21. The arc-shaped jointing portion 232 has a first end connected to the resilient contact portion 231 and a second end connected to the base portion 21 at a point as a second fulcrum P2. The lower boss 233 with a substantial triangular shape protrudes from a tip of the resilient contacts portion 231, corresponds to the upper boss 225 and is rested on the blocking rib 17 for electrical connection to the electronic card 9.

Figure 5:
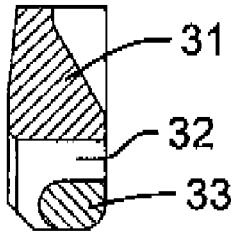
FIG. 5 is a cross sectional end view of an operating member of the electrical connector in FIG. 1 in accordance with the present invention.

With reference to FIGS. 2 and 5, the operating member 3 is pivotally connected to the insulative housing 1 in the cavity 5 and comprises a control lever portion 31, a plurality of through channels 32, a plurality of rotating base portions 33, shafts 34 and protrusions 35.

The meshing portions 224 of the terminals 2 are respectively mounted in the through channels 32. The rotating base portions 33 are respectively provided in the through channels 32 to mesh or engage the meshing portions 224 of the terminals 2. Since each rotating base portion 33 is elliptic in cross-section, each meshing portion 224 may have an arc surface to fit the rotating base portions 33, achieving a much smoother relative rotation between the rotating base portion 33 and the meshing portion 224. The shafts 34 provided on the operating member 3 are rotatably fitted to and locked in the holes 151 formed in the insulative housing 1 to prevent the operating member 3 from disengaging from the insulative housing 1.

Figure 6A:
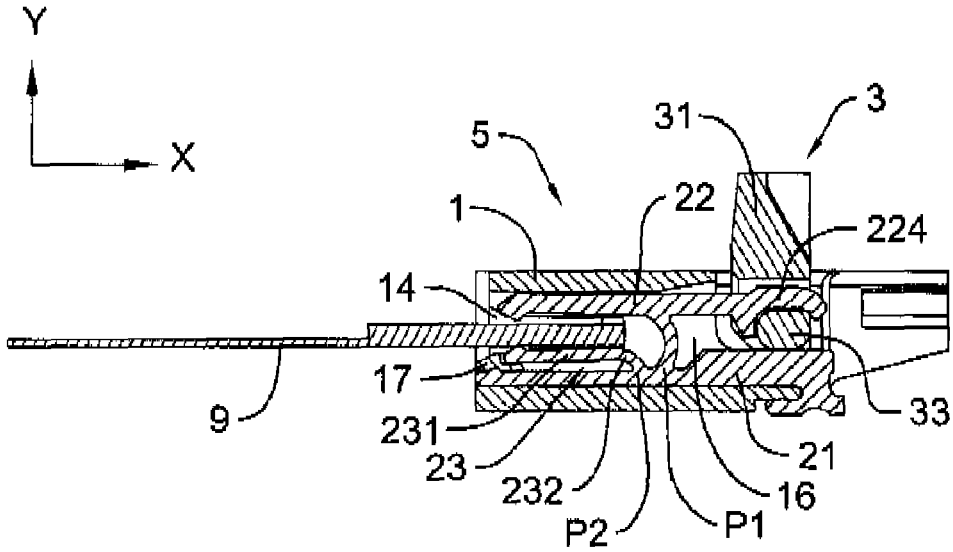
FIG. 6A is an operational cross sectional view of the electrical connector in accordance with the present invention with the operating member not being applied with a force.

With further reference to FIGS. 6A and 613, to explain the mechanical operations of the electrical connector 5 relative to the electronic card 9, two directions are indicated by arrows X and Y.

When the control lever portion 31 of the operating member 3 is not yet operated and extends in the direction Y as shown in FIG. 6A, the electrical connector 5 is in an open state so that the electronic card 9 can be insert into the slot 14. The bottom surface of the electronic card 9 contacts the joining portion 232 of the lower arm 23.

Figure 6B:
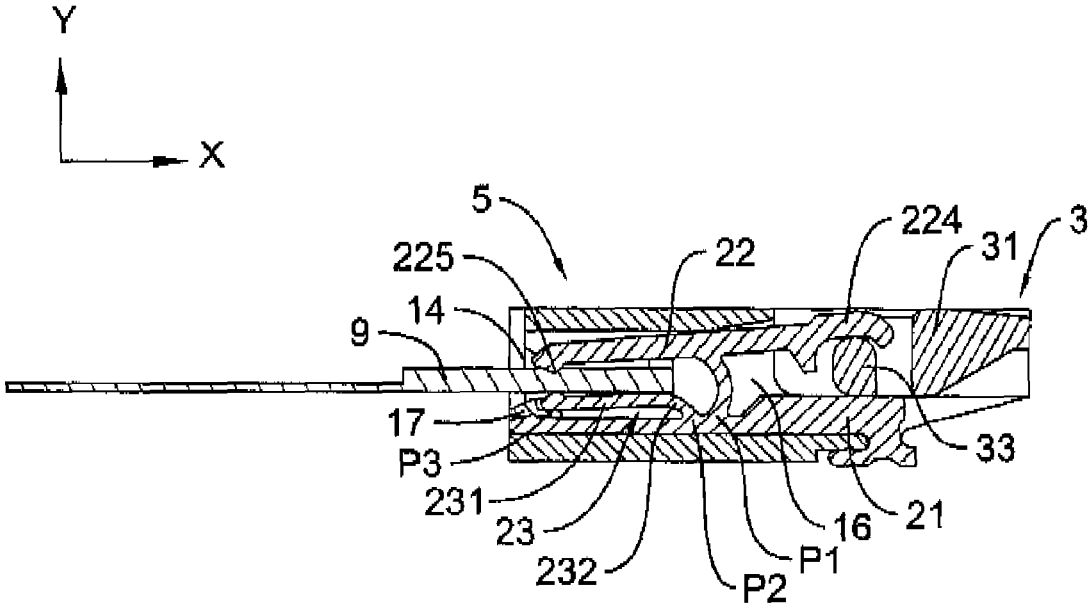
FIG. 6B is an operational cross sectional view of the electrical connector in accordance with the present invention with the operating member being pushed to rotate downward.

When the control lever portion 31 of the operating member 3 is pushed to rotate downward and extends in the direction X parallel to the base portion 21 as shown in FIG. 6B, the electrical connector 5 is in an closed state so that the electronic card 9 securely engages in the slot 14. The protrusions 35 formed on the operating member 3 correspondingly mounted in the grooves 152 of the inner surfaces of the cavity 15 to prevent the connector 5 from being easily brought into an open state.

Since the operating member 3 rotates downward to a predetermined position, the rotating base portions 33 enlarge a gap between the meshing portion 224 and the base portion 21. Because the meshing portion 224 is elevated, the contact portion 223 rotates downward about the first fulcrum P1 and the upper boss 225 is lowered along a direction opposite to Y to electrically abut and contact the electronic card 9.

Furthermore, because the lower surface of the electronic card 9 abuts the joining portion 232 of the lower arm 23, the electronic card 9 presses the joining portion 232 downward as the upper boss 225 continues pushing the electronic card 9. Therefore, the lower arm 23 rotates downward about the second fulcrum P2 and comes closer to the base portion 21.

Since the tip of the resilient contact portion 231, i.e. the lower boss 233, is supported on the blocking rib 17, the lower boss 233 abuts against the lower surface of the electronic card 9 under reaction force while the resilient contact portion 231 gradually rotates about the second fulcrum P2, and the position where the lower boss 233 overlaps on the blocking rib 17 serves as an imaginary fulcrum P3.

In short, the upper boss 225 and the lower boss 233 of the electrical connector 5 are able to tightly contact the electronic card 9 based on the two fulcrums P1 and P2 that permit the upper arm 22 and the lower arm 23 being rotated to predetermined positions and clamping the electronic card 9. In otherworlds, the electrical connector 5 can offer an enhanced electrical connection to the electronic card 9 with the dual contacts.

Since the upper boss 225 and the lower boss 233 are triangular, the upper arm 22 and the lower arm 23 can tightly grasp the electronic card 9 when the connector 5 is in the closed state to prevent the connector 5 from being easily brought into an open state due to impact and vibration.

If the conductive portions 91 are formed on the bottom surface of the electronic card 9, the path for signal transmission between the lower arm 23 and the terminal portion 212 is much shorter.

Figure 8:
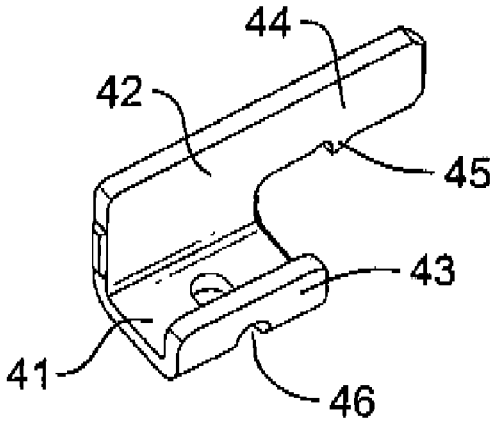
FIG. 8 is a perspective view of a mounting plate for the electrical connector in FIG. 7 in accordance with the present invention.

With reference to FIGS. 7 and 8, the mounting plate 4 has a U-shaped structure in cross section and comprises a bottom plate 41 two side plate portions 42, 43, a mounting arm 44, a lock projection 45 and a through hole 46. The two side plate portions 42, 43 extend perpendicularly and respectively from two opposite edges of the bottom plate 41. The mounting arm 44 protrudes from one side plate portion 42. The lock projection 45 is formed on a lower edge of the mounting arm 44. The through hole 46 is defined through portions of the bottom plate 41 and the other side plate 43.

To assemble the mounting plate 4 to the electrical connector 5, one side plate portion 42 with the mounting arm 44 extend into the insulative housing 1 and to engage the insulative housing 1 by the lock protrusion 45. The other side plate portion 46 is exposed. When the electrical connector 5 is mounted on the printed circuit board 8, the melted solder can flow to the through hole 46 to join the electrical connector 5 and the printed circuit board 8 together.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector adapted to be electrically connected between an electronic card and a printed circuit board, the electrical connector comprising:

an insulative housing comprising a front surface;

a rear surface;

a top surface;

a slot defined in the front surface and having an inner bottom surface;

a cavity defined on the top surface, adjacent to the rear surface and having two opposite inner surfaces; and a plurality of receiving spaces defined in the insulative housing side by side and communicating with the slot and the cavity;

a plurality of terminals mounted in the receiving spaces respectively, each of the terminals comprising:

a base portion;

an upper arm having a first beam having a front end and a rear end and comprising a contact portion extending from the front end and toward the front surface of the insulative housing; and a meshing portion extending from the rear end and toward the rear surface of the insulative housing opposite to the contact portion; and an arc-shaped support post projecting in a direction toward the rear surface of the insulative housing, connected to the first beam, and joined to the base portion at a point serving as a first fulcrum;

a lower arm located between the contact portion and the base portion and having a resilient contact portion connected to the to the base portion through an arc-shaped joining portion, wherein the arc-shaped joining portion is joined to the base portion at a point serving as a second fulcrum; and an operating member pivotally connected to the insulative housing in the cavity to control the plurality of terminals being operated in an open state or a closed state, and comprising a plurality of through channels;

a plurality of rotating base portions respectively formed in the through channels, each of the rotating base portions being elliptical in cross-section and rotatably meshing with the meshing portion of the terminal and always abutting between the meshing portion and the base portion in both the open state and the closed state.

2. The electrical connector as claimed in claim 1, wherein the upper arm further comprises a triangular upper boss protruding from a tip of the contact portion toward the lower arm.

3. The electrical connector as claimed in claim 1, wherein the lower arm further comprises a triangular lower boss protruding from a tip of the resilient contact portion toward the upper arm.

4. The electrical connector as claimed in claim 1, wherein the insulative housing further comprises a block rib formed on the inner bottom surface of the slot adjacent to the front surface.

5. The electrical connector as claimed in claim 4, wherein the base portion of each terminal further comprises:

a locking projection formed on one end of the base portion; and a terminal portion formed on another end of the base portion and extending outward from the insulative housing.

6. The electrical connector as claimed in claim 1, wherein the meshing portion has an arc surface to fit the rotating base portions.

7. The electrical connector as claimed in claim 1 further comprising at least one mounting plate mounted in the insulative housing.

8. The electrical connector as claimed in claim 7, wherein the mounting plate is a U-shaped structure in cross section and comprises a bottom plate and two side plate portions with one of the two side plate portions extending outward the insulative housing.

9. The electrical connector as claimed in claim 8, wherein the mounting plate further comprises a mounting arm extending from the side plate mounted in the insulative housing.

10. The electrical connector as claimed in claim 9, wherein the mounting plate further comprises a lock projection formed on the extending arm.

11. The electrical connector as claimed in claim 8, wherein the mounting plate further has a through hole defined through portions of the bottom plate and the side plate extending outward the insulative housing.

12. The electrical connector as claimed in claim 1, wherein the two opposite inner surfaces of the cavity are defined with holes and grooves; and the operating member further has shafts rotatably fitted to and locked in the holes of the cavity; and protrusions correspondingly mounted in the grooves of the inner surfaces of the cavity.

* * * * *